United States Patent [19]

Scott

[11] 4,140,157

[45] Feb. 20, 1979

[54] MOLDED COUPLING ELEMENT FOR WOVEN SLIDE FASTENER WITH TWIST PREVENTING PROJECTION

[75] Inventor: George W. Scott, Conneaut Lake, Pa.

[73] Assignee: Textron Inc., Providence, R.I.

[21] Appl. No.: 724,224

[22] Filed: Sep. 17, 1976

[51] Int. Cl.[2] ..... A44B 19/30

[52] U.S. Cl. ..... 139/384 B; 24/205.13 R; 24/205.16 R

[58] Field of Search ..... 139/384 B; 24/205.13 D, 24/205.13 R, 205.16 R

[56] References Cited

U.S. PATENT DOCUMENTS

| | | | |
|---|---|---|---|
| 3,047,922 | 8/1962 | Schwendt et al. | 24/205.16 R |
| 3,179,996 | 4/1965 | Clauss | 24/205.13 R |
| 3,490,111 | 1/1970 | Waldes | 24/205.13 R |
| 3,508,304 | 4/1970 | Burbank | 24/205.13 R |
| 3,900,929 | 8/1975 | Takamatsu | 24/205.16 R |
| 3,977,053 | 8/1976 | Takamatsu | 24/205.16 R |

*Primary Examiner*—Henry S. Jaudon

*Attorney, Agent, or Firm*—O'Brien and Marks

[57] ABSTRACT

Coupling elements molded on connecting threads have projections or fins extending in a direction from the connecting threads toward heels of the elements; the projections are engaged within weft or filler thread loops on the inner edges of woven tapes supporting the coupling elements by the loops extending around the connecting threads. The projections inhibit twisting of the coupling elements.

8 Claims, 4 Drawing Figures

MOLDED COUPLING ELEMENT FOR WOVEN SLIDE FASTENER WITH TWIST PREVENTING PROJECTION

BACKGROUND OF THE INVENTION

1. Field of the Invention

The invention relates to slide fasteners, and particularly, to woven slide fasteners employing spaced coupling elements continuously molded on connecting threads to form coupling element trains which are attached to edges of the support tapes by loops of the tape weft thread passing around the connecting threads between the elements.

2. Description of the Prior Art

U.S. Pat. No. 3,328,857 discloses a fastener stringer with a pair of cords and plastic fastener elements molded to the cords with sections of the cords covered by molded plastic material in alternate and staggered spaces between the leg portions of adjacent elements, the filling threads of a woven tape passing over the cords as well as warp threads of the tape between opposite leg portions of each element; ordinary slide fastener stringer weaving apparatus and techniques cannot be used to interweave filler threads with connecting cords joining leg portions of adjacent coupling elements and further warp threads extending between the opposite leg portions of each coupling element.

In woven slide fastener stringers employing spaced coupling elements molded on the connecting threads wherein the weft thread is looped at an edge of the tape around the connecting threads between the elements to secure the elements to the edge of the tape, the elements tend to twist (i.e. rotate about an axis defined by the edge of the tape) relative to the tape and each other since the connecting threads are very flexible and cannot prevent such twisting of the coupling elements; such twisting often prevents the interlocking of the elements with mating elements of an opposing stringer.

The art also contains, as illustrated in U.S. Pat. No. 3,328,857, No. 3,414,948, No. 3,445,915 and No. 3,696,473, a number of slide fasteners employing spaced coupling elements molded on connecting threads wherein the trains of coupling elements are attached to the edge of the tape by stitches passing over leg portions of the coupling elements. U.S. Pat. No. 3,487,531 discloses the passing of an interwoven warp thread over the leg portions of a coupling element to secure the train of coupling elements to the edge of a tape.

SUMMARY OF THE INVENTION

The invention is summarized in a woven stringer for a slide fastener including a woven tape having a plurality of warp threads and a weft thread interwoven with the warp threads, a coupling element train having at least one connecting thread and a plurality of spaced polymer coupling elements molded on the connecting thread, each of the coupling elements having a head and a heel at opposite ends thereof, the connecting thread having spaced segments embedded in the respective coupling elements intermediate the head and the heel, the train being secured to one longitudinal edge of the tape by a plurality of loops of the weft thread passing around the connecting thread between the coupling elements, and each of the coupling elements having at least one projection extending in a direction from the connecting thread toward the heel and extending parallel to the tape within respective loops of the plurality of loops of the weft thread to inhibit twisting of the coupling elements.

An object of the invention is to construct a slide fastener employing coupling elements molded on connecting threads which are woven by existing techniques to the edge of the tape wherein the coupling elements have a reduced tendency to twist about the edge of the tape.

An advantage of the invention is that projections extending from each coupling element parallel to the tape are engaged within the loops of weft thread passing around the connecting threads to prevent twisting of the coupling elements.

Another advantage of the invention is that heel portions of the coupling elements are welded together to form a unitary body of the coupling element.

Other objects advantages, and features of the invention will be apparent from the following description of the preferred embodiment taken in conjunction with the accompanying drawings.

DESCRIPTION OF THE PREFERRED EMBODIMENT

Figure 1:
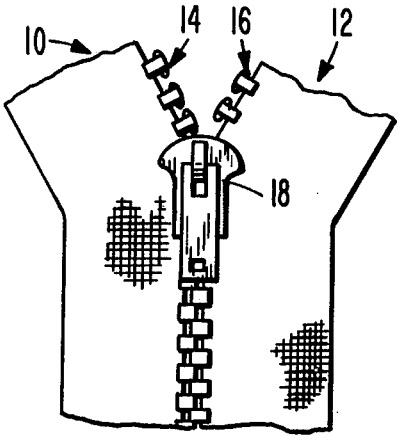
FIG. 1 is a plan view of a slide fastener in accordance with the invention.

As illustrated in FIG. 1, a slide fastener in accordance with the invention includes a pair of carrier tapes indicated generally at 10 and 12 and a pair of trains of coupling elements indicated generally at 14 and 16 secured to the inner edges of the tapes 10 and 12. A slider 18 is slidably mounted on the coupling elements 14 and 16 for opening and closing the slide fastener. As viewed in FIG. 1, the tape 10 and coupling elements 14 form a left stringer while the tape 12 and the coupling elements 16 form a right stringer; the left and right stringers together forming a chain for the slide fastener. The right stringer is substantially a mirror image of the left stringer, and for the sake of brevity only the left stringer is shown and described in detail.

Figure 2:
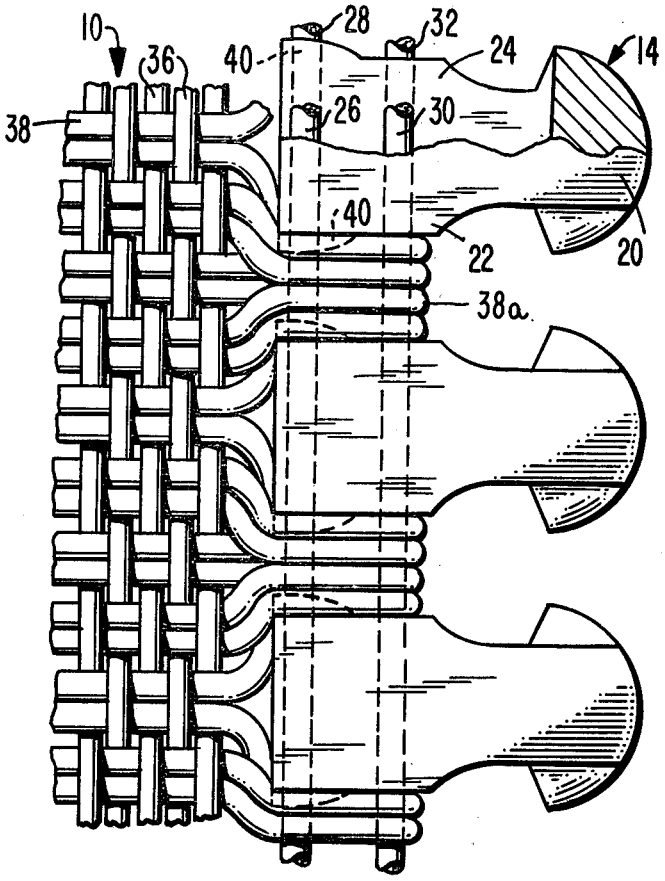
FIG. 2 is an enlarged view of a cutaway portion of the fastener of FIG. 1.
Figure 3:
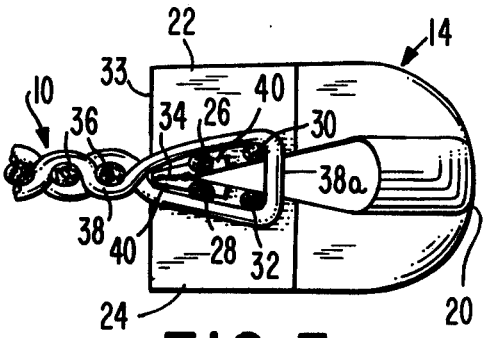
FIG. 3 is a cross-section view of the portion of FIG. 2.
Figure 4:
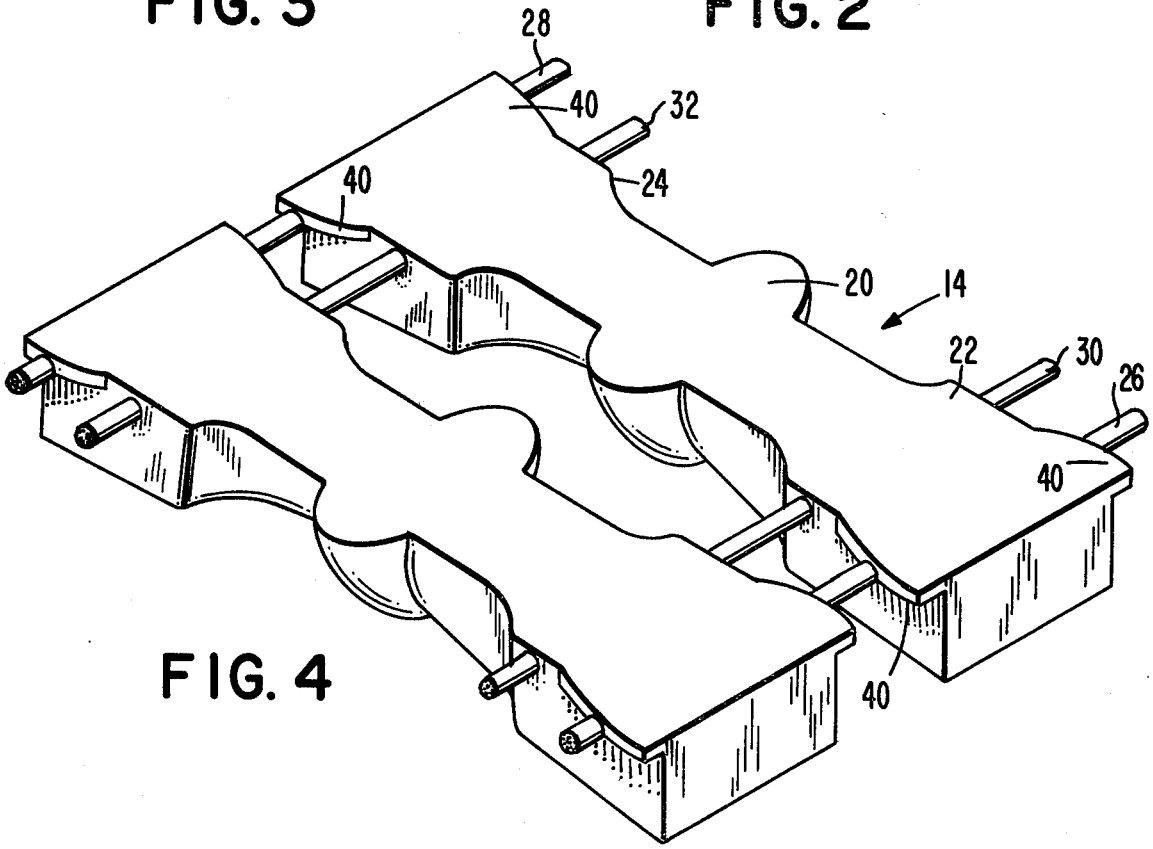
FIG. 4 is a perspective view of a coupling element train prior to folding and attaching to a tape in the fastener of FIGS, 1–3.

Each of the coupling elements 14, as shown in FIGS. 2 and 3, has a head portion 20 designed to interlock with head portions of the opposite stringer. Upper and lower leg portions 22 and 24 extend in the same direction from opposite sides of each head portion 20. Spaced segments of each of four connecting threads 26, 28, 30, and 32 are imbedded in the respective leg portions 22 and 24 near converging inside surfaces thereof; one pair of the connecting threads 26 and 28 is adjacent to the heel 33 of the coupling element whereat the leg portions are bonded or sealed together such as by a weld 34, while the other pair of the connecting threads 30 and 32 is secured in the respective leg portions 22 and 24 at locations spaced toward the head portions 20 from the pair of threads 26 and 28. The train of coupling elements is initially manufactured in a flat condition as shown in FIG. 4 by molding a polymer such as a thermoplastic in a molding apparatus such as an injection molding apparatus with a row of cavities intersected by connecting thread receiving grooves. Subsequently the leg portions 22 and 24 are bent about the head portion 20 to extend generally in the same direction from the head portion 20. The heels of the leg portions 22 and 24 are then bonded together to secure leg portions 22 and 24 together.

The tape 10 has a plurality of warp threads 36 with an interwoven weft or filler thread 38 which has loops 38*a* encircling or passing around the connecting threads 26, 28, 30 and 32 between the coupling elements 14 to secure the train of the coupling elements to the inner edge of the tape. Weaving of the weft thread 38 with the warp threads 36 and train of coupling elements 14 is performed by conventional slide fastener stringer weaving apparatus and techniques.

Each coupling element 14 has ledges or projections 40 extending from both the front and back sides from each leg portion 22 and 24 in directions parallel to the longitudinal dimension of the tape 10. Inside surfaces of the projection are planar with the inside surfaces of the leg portions 22 and 24, respectively. The projections 40 have a thickness (i.e. dimension perpendicular to the inside surfaces of the leg portions 22 and 24) which is substantially less than the thickness of the connecting threads 29, 30, 32 and 34 which are much thinner than the leg portions 22 and 24, and have a width (i.e. dimension perpendicular to the front and back sides of the leg portions 22 and 24) so that the projections 40 are engaged within or covered by the loops 38*a* of the weft thread 38 adjacent to the coupling elements 14. The projections 40 have a length (i.e. dimension parallel the longitudinal dimensions of the leg portions 22 and 24) which extends from the heel of the leg portions 22 and 24 to a point intermediate the connecting threads 26 and 30 in the leg portion 20 or intermediate the connecting threads 28 and 32 in the leg portion 24.

In operation of the slide fastener, downward movement of the slider 18 as viewed in FIG. 1 opens the slide fastener by disengaging the head portions 20 of the coupling elements 14 and 16; and upward movement of the slider 18 closes the fastener by interengaging the head portions 20 of the elements 14 and 16. The connecting threads 26, 28, 30 and 32 have less tendency to being pulled from the leg portions, and the coupling elements 12 and 14 have less tendency to twist relative to the tape and each other.

The union between the leg portions 22 and 24 and the connecting threads is greatly improved by the bond 34 formed between the leg portions 22 and 24 adjacent the heels thereof. The connecting threads 26, 28, 30 and 32, being only shallowly embedded in the coupling elements 14 on the inside of the leg portions 22 and 24, have a tendency to be pulled from the coupling elements 14 by crosswise forces on the tapes 10 and 12 in the abscence of the bond 34; but the bond 34 joins inside surfaces of the leg portions 22 and 24 together to form a unitary heel portion wherein the connecting threads, particularly the threads 26 and 28, are centrally imbedded to greatly reinforce the union of the connecting threads 26, 28, 30 and 32 with the leg portions 22 and 24.

The engagement of the weft thread 38 with the projections 40 in both the front and back sides of each coupling element 14 inhibits the coupling elements 14 from twisting or rotating about an axis defined by the edge of the tape 10 supporting the coupling elements 14. In the absence of the projections 40 which are substantially more rigid than the connecting threads 26, 28, 30 and 32, the coupling elements 14 often twist relative to the tape and each other preventing the interlocking of the head portions 20 of the mating coupling elements 14 and 16 as well as interfering with proper slider action in closing and opening the slide fastener.

It is also noted that the projections 40 on the opposite leg portions 22 and 24 of each coupling element 14 diverge from the heel 33 to the points intermediate the respective pairs of connecting threads in each leg portion 22 and 24. This divergence results in the loops 38*a* converging at the heel 33 near the first warp thread 36 tending to hold the converged points of the projections 40 in the base of the loops 38*a* where the weft thread 38 crosses.

Since many modifications, changes in detail and variations can be made in the present embodiment, it is intended that all matter in the foregoing description and shown in the accompanying drawings be interpreted as illustrative and not in a limiting sense.

What is claimed is:

1. A woven stringer for a slide fastener comprising
   a woven tape having a plurality of warp threads and a weft thread interwoven with the warp threads,
   a coupling element train having at least one connecting thread and a plurality of spaced polymer coupling elements molded on the connecting thread,
   each of said coupling elements having a head and a heel at opposite ends thereof,
   said connecting thread having spaced segments embedded in the respective coupling elements intermediate the head and the heel,
   said train being secured to one longitudinal edge of the tape by a plurality of loops of the weft thread passing around the connecting thread between the coupling elements,
   each of said coupling elements having at least one elongated projection having a length extending in a direction from the connecting thread toward the heel and having a width extending parallel to the tape within respective loops of the plurality of loops of the weft thread to inhibit twisting of the coupling elements, and
   said projections having a thickness substantially less than a thickness of the coupling elements and substantially less than the length of the projections.

2. A woven stringer as claimed in claim 1 wherein each coupling element has a pair of leg portions between the head and the heel and the leg portions are bonded together at the heel.

3. A woven stringer as claimed in claim 2 wherein the coupling element train includes at least a pair of connecting threads, at least one connecting thread in each respective leg portion of each coupling element, each coupling element includes at least four projections, a pair of which projections extend on respective opposite sides of each leg portion of each coupling element.

4. A woven stringer as claimed in claim 3 including at least four connecting threads, one pair of which is embedded in each of the leg portions.

5. A woven stringer as claimed in claim 4 wherein each projection has a thickness substantially less than the thickness of the leg portions and has a length extending from the heel of the coupling element to a point intermediate to the pair of connecting threads in each leg portion.

6. A woven stringer as claimed in claim 5 wherein each projection is tapered to have decreasing width from the respective heel to the point intermediate the respective pair of connecting threads.

7. A woven stringer as claimed in claim 5 wherein the projections on each coupling element have inside surfaces which are planar with inside surfaces of the leg portions.

8. A woven stringer for a slide fastener comprising a woven tape having a plurality of warp threads and a weft thread interwoven with the warp threads;

a coupling element train having at least four spaced parallel connecting threads and a plurality of spaced polymer coupling elements molded on the connecting threads;

each of said coupling elements having a head and a heel at opposite ends thereof and having a pair of leg portions between the head and the heel with the leg portions being bonded together at the heel;

pairs of said four connecting threads having spaced segments embedded in the respective leg portions of each coupling element intermediate the head and the heel;

said train being secured to one longitudinal edge of the tape by a plurality of loops of the weft thread passing around the connecting threads between the coupling elements;

each of said coupling elements having at least four projections, a pair of which extend on opposite sides of a respective leg portion of each coupling element extending in a direction from the respective connecting threads toward the heel and extending parallel to the tape within respective loops of the plurality of loops of the weft thread to inhibit twisting of the coupling elements;

each of said projections having a thickness substantially less than the thickness of each leg portion and having a length extending from the heel of the coupling element to a point intermediate to the pair of connecting threads in each leg portion;

said projections of each coupling element having inside surfaces which are planar with inside surfaces of the leg portions; and said projections on each side of each coupling element diverging from the heel toward the points intermediate the connecting threads of the respective leg portions.

* * * * *